US010232990B2

(12) United States Patent
Sang et al.

(10) Patent No.: US 10,232,990 B2
(45) Date of Patent: Mar. 19, 2019

(54) CHILD RESISTANT STORAGE CONTAINER

(71) Applicants: George Sang, Chicago, IL (US); Brian Estey, Littleton, CO (US)

(72) Inventors: George Sang, Chicago, IL (US); Brian Estey, Littleton, CO (US)

(73) Assignee: COMPLIANT PACKAGING LLC, Chicago, IL (US)

( * ) Notice: Subject to any disclaimer, the term of this patent is extended or adjusted under 35 U.S.C. 154(b) by 0 days.

(21) Appl. No.: 15/862,009

(22) Filed: Jan. 4, 2018

(65) Prior Publication Data

US 2018/0186524 A1 Jul. 5, 2018

Related U.S. Application Data

(60) Provisional application No. 62/442,622, filed on Jan. 5, 2017.

(51) Int. Cl.
*B65D 50/04* (2006.01)

(52) U.S. Cl.
CPC ..... *B65D 50/043* (2013.01); *A61J 2205/30* (2013.01); *B65D 2215/02* (2013.01); *B65D 2583/0404* (2013.01)

(58) Field of Classification Search
CPC .... B65D 83/04; B65D 41/0471; B65D 41/04; B65D 41/06; B65D 51/245; B65D 50/043; B65D 50/04; B65D 50/02; B65D 50/041; B65D 51/18; B65D 51/24
USPC ..... 215/216, 217, 220, 219, 201, 230, 330, 215/329, 316, 228, 218, 221; 220/254.9, 220/254.8, 259.4, 259.3, 230, 293, 288, 220/212; 206/538, 530, 528
See application file for complete search history.

(56) References Cited

U.S. PATENT DOCUMENTS

| | | | | |
|---|---|---|---|---|
| 3,679,085 | A * | 7/1972 | Gach | B65D 50/041 215/220 |
| 3,923,185 | A * | 12/1975 | Choksi | B65D 50/067 215/253 |
| 5,096,078 | A * | 3/1992 | McQueeny | B65D 51/26 206/522 |
| 6,382,450 | B1 * | 5/2002 | De Rosa | B65D 41/02 206/818 |
| 7,815,061 | B1 * | 10/2010 | Robinson | B29C 45/1676 215/220 |
| 8,857,638 | B2 * | 10/2014 | Brozell | B65D 50/041 215/219 |
| 8,931,657 | B2 * | 1/2015 | Kientzle | A61J 1/03 206/514 |
| 9,187,220 | B2 * | 11/2015 | Biesecker | B65D 43/0212 |
| 9,481,496 | B2 * | 11/2016 | Cottle | A24F 15/00 |
| 2007/0090110 | A1 * | 4/2007 | Skelton | B65D 41/0478 220/254.9 |

* cited by examiner

*Primary Examiner* — Robert J Hicks
(74) *Attorney, Agent, or Firm* — Justin Lampel

(57) ABSTRACT

A child resistant storage container is provided. The child resistant storage container has a housing having a top half, a bottom half and a generally hollow interior storage area. A locking mechanism temporarily secures the top half of the device to the bottom half of the device. The top half has a plurality of opposing teeth that allow the top half to be separated from the bottom half only when the locking teeth of the top half are engaged with each other. The interior of the child resistant storage container may be used to store items such as medications.

7 Claims, 4 Drawing Sheets

CHILD RESISTANT STORAGE CONTAINER

CROSS-REFERENCE TO RELATED APPLICATIONS

The following application is based on and claims the priority benefit of U.S. provisional application Ser. No. 62/442,622 filed Jan. 5, 2017 currently co-pending; the entire contents of both which are incorporated by reference.

BACKGROUND OF THE INVENTION

A child resistant storage container is provided. The child resistant storage container has a housing having a top half, a bottom half and a generally hollow interior storage area. It is understood that although the application states "half", the top portion and the bottom portion may be of different sizes. A locking mechanism temporarily secures the top half of the device to the bottom half of the device. The locking mechanism has a first threaded member located on the top half of the device and a second corresponding threaded member on the bottom half of the device. Depressing the top half toward the bottom half unlocks the first threaded member from the second threaded member and allows the user to twist the top half with respect to the bottom half and, therein, allows a user to separate the top half of the device from the bottom half. The top half has a plurality of opposing teeth that allow the top half to be separated from the bottom half only when the locking teeth of the top half are engaged with each other. The interior of the child resistant storage container may be used to store items such as medications.

Child resistant storage containers have been made in the past. For example, U.S. Pat. No. 9,481,496 to Cottle discloses a child resistant container for nicotine products. The container comprises latching elements adapted to interlock with cooperating latching elements when said lid is pushed onto a said base to retain said lid to said base. The latching elements are further adapted to disengage from said cooperating latching elements when a simultaneous force is exerted on all releasable latching arrangements by two hands of a user or the like.

Further, U.S. Pat. No. 9,187,220 to Biesecker discloses a cap having a top wall, an outer peripheral edge, a first section, and a second section. A skirt depends from the outer peripheral edge. The skirt includes an attached end, a free end, a plurality of slots, and a plurality of apertures. Each aperture is spaced-apart from the free end of the skirt. The top wall has a first configuration and a second configuration. When the top wall is in the first configuration, the first section is generally planer and the second section is generally arcuate. When the top wall is in the first configuration, the skirt extends generally perpendicularly to the first section to generally engage at least a portion of a container. When the top wall is in the second configuration, the free end of the skirt extends radially outwardly from the attached end thereof to allow the cap to be removed from the container.

Still further, U.S. Pat. No. 8,931,657 to Kientzle discloses a pharmaceutical container having a bottle having a bottom wall and side walls. A ridge proximate to the bottom wall projects from an interior surface of at least one of the side walls, to facilitate nested stacking of a plurality of bottles. One or more of the side walls includes a cover locking receptacle proximate to the top end of the side wall. The pharmaceutical container also includes a cover including a sliding lid contained in a cover housing. The cover housing has a top wall, which includes an opening, and cover side walls. A child-resistant closure mechanism is also provided to limit the movement between the sliding lid and the bottle.

However, these child resistant storage containers fail to provide a child resistant container which is easy to use, quick and inexpensive. The container may be easily opened in one smooth twisting motion while depressing downward. Further, these devices fail to provide a child resistant container which allows a user to utilize two units to create a container.

SUMMARY OF THE INVENTION

A child resistant storage container is provided. The child resistant storage container has a housing having a top half, a bottom half and a generally hollow interior storage area. It is understood that although the application states "half", the top portion and the bottom portion may be of different sizes. A locking mechanism temporarily secures the top half of the device to the bottom half of the device. The locking mechanism has a first threaded member located on the top half of the device and a second corresponding threaded member on the bottom half of the device. Depressing the top half toward the bottom half unlocks the first threaded member from the second threaded member and allows the user to twist the top half with respect to the bottom half and, therein, allows a user to separate the top half of the device from the bottom half. The top half has a plurality of opposing teeth that allow the top half to be separated from the bottom half only when the locking teeth of the top half are engaged with each other. The interior of the child resistant storage container may be used to store items such as medications.

An advantage of the present child resistant storage container is that the present child resistant storage container is easy to use for adults while preventing children from gaining access to the interior of the container. The device is especially suitable for seniors which typically have difficulty opening child resistant containers.

Still another advantage of the present child resistant storage container is that the present container lacks exterior sharp edges and corners which may otherwise injure someone or tear clothing. The present device may simply slide easily into pockets.

Yet another advantage of the present child resistant storage container is that the present child resistant storage container may have indicia located on the top half of the device to provide instructions to a user and to provide information related to the contents of the storage container. The information may be embossed, debossed, printed, etched, silkscreened or provided on a color shrink sleeve.

And another advantage of the present child resistant storage container is that the present child resistant storage container may have a support ring which extends from the bottom half and prevents items from falling out of the interior of the storage container.

Another advantage of the present child resistant storage container is that the present child resistant storage container may, in one embodiment, be magnetic so as to provide a better seal for the device and so as to allow the device to be secured to, for example, a refrigerator.

Further, in an embodiment, a two-sided adhesive material or a hook and loop fastener system to may be used to secure on portion of the device to an object.

Still another advantage of the present child resistant storage container is that the device has interlocking teeth which must be activated in order to separate the top half of the container from the bottom half of the container. A user must depress the top half to lock the teeth together so that the top half may be twisted and removed, exposing the interior of the container.

For a more complete understanding of the above listed features and advantages of the present child resistant storage container reference should be made to the following detailed description of the preferred embodiments. Further, additional features and advantages of the invention are described in, and will be apparent from, the detailed description of the preferred embodiments.

DETAILED DESCRIPTION OF THE PREFERRED EMBODIMENTS

A child resistant storage container is provided. The child resistant storage container has a housing having a top half, a bottom half and a generally hollow interior storage area. It is understood that although the application states "half", the top portion and the bottom portion may be of different sizes. A locking mechanism temporarily secures the top half of the device to the bottom half of the device. The locking mechanism has a first threaded member located on the top half of the device and a second corresponding threaded member on the bottom half of the device. Depressing the top half toward the bottom half unlocks the first threaded member from the second threaded member and allows the user to twist the top half with respect to the bottom half and, therein, allows a user to separate the top half of the device from the bottom half. The top half has a plurality of opposing teeth that allow the top half to be separated from the bottom half only when the locking teeth of the top half are engaged with each other. The interior of the child resistant storage container may be used to store items such as medications.

Figure 1:
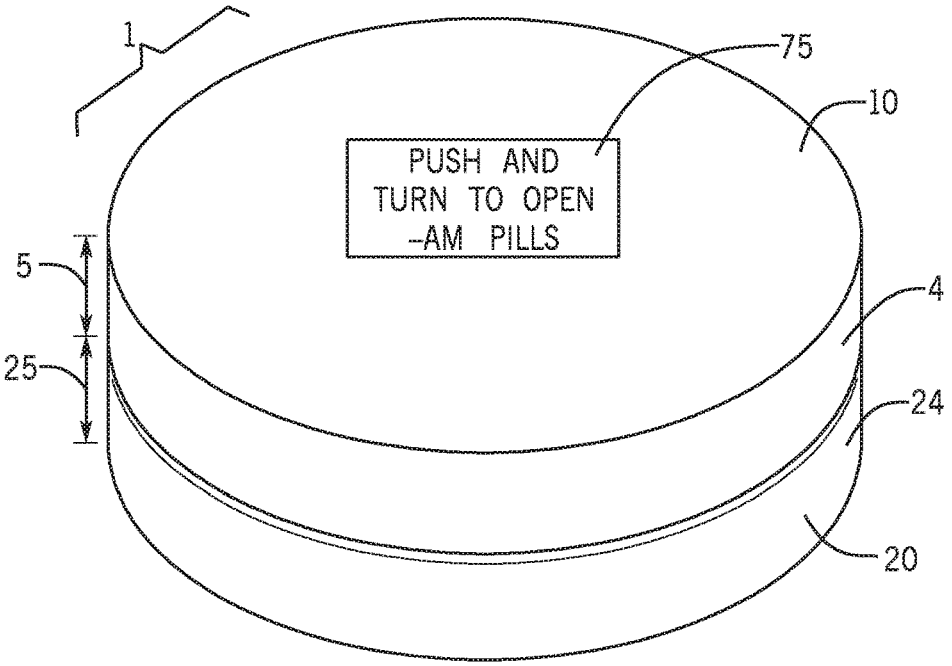
FIG. 1 illustrates a top view of the child resistant storage container wherein the top half and the bottom half are secured together and the device may not be opened by a child.

Referring first to FIG. 1, in an embodiment, a child resistant storage container 1 is provided. The child resistant storage container 1 may have a top half 10 and a bottom half 20. When the top half 10 and the bottom half 20 are secured together, an interior storage area 8 (FIG. 2) of the device 1 is created wherein the interior 8 may store, for example, an object 50 such as medication. In an embodiment, the child resistant storage container 1 may be made from, for example, metal, plastic, a rigid material or combination of these materials. In an embodiment, indicia 75 may be printed on, for example, the top half 10 of the device 1 which relates to opening and closing instructions as well information related to the contents of the device 1.

In an alternative embodiment, the top half (or 'unit') 10 and the bottom half (or 'unit') 20 may be magnetic (having different polarity orientation) so that the top half 10 is lightly attracted to the bottom half 20 when in the proper orientation of FIG. 1. This increases security and further prevents children from accessing the interior 8 of the device 1. In addition, the magnetic nature of the device 1 may further allows a user to secure the device 1 up high, for example, near the top of a refrigerator (not shown).

In an embodiment, the top half 10 may have a diameter 15 (FIG. 2) which is equal to a diameter 35 of the bottom half 20. Further, the top half 10 may have a side 4 having a height 5 which is substantially equal to a side 24 having a height 25 of the bottom half 20. Preferably, the top half 10 and the bottom half 20 are cylindrical in shape and mirror images of each other. In an alternative embodiment, the exterior shape of the device is not limited to a cylindrical shape even though the inner locking mechanism with the ratcheted threading (as discussed below) will still be round.

Figure 6:
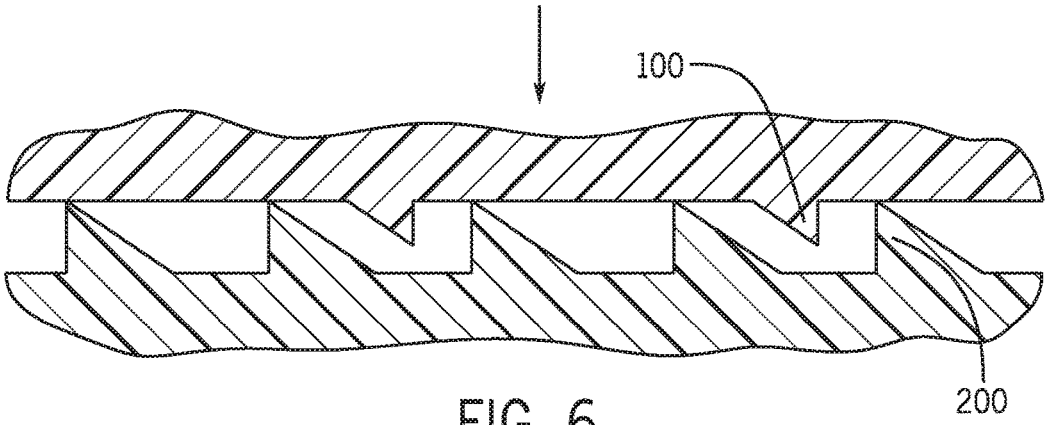
FIG. 6 illustrates a cross section of the locking teeth of the top half of the container wherein the locking teeth of the top half are not yet engaged with each other and the top half cannot (yet) be separated from the bottom half of the container.
Figure 7:
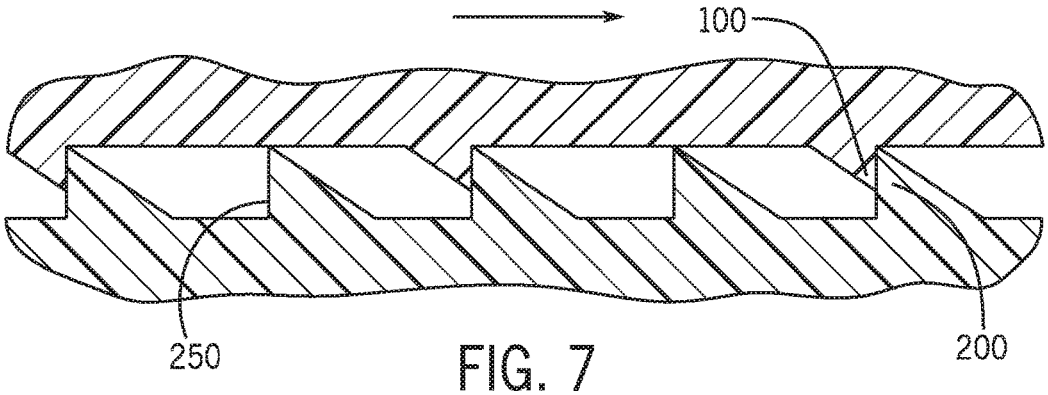
FIG. 7 illustrates a cross section of the locking teeth of the top half of the container wherein the locking teeth of the top half are engaged with each other and a user may therein twist and separate the top half of the container from the bottom half of the container.

In an embodiment, the top half 10 of the container 1 may have a stationary portion 11 (or "base" portion) and a rotatable ring 17. Preferably, the rotatable ring 17 is plastic, but may be made of other suitable materials. The rotatable ring 17 may rotate with respect to the stationary portion 11 of the top half 10 as is shown in FIGS. 6 and 7. The rotatable ring 17 may have an interior facing side having a first threaded member 18.

The bottom half 20 of the container 1 may have a stationary support ring 27 which is attached to the bottom half 20 of the container 1 wherein the stationary support ring 27 does not move with respect to the bottom half 20. The stationary support ring 27 of the bottom half 20 may be located near a top 21 of the bottom half 20. The stationary support ring 27 may have a corresponding second threaded member 28 which interlocks with the first threaded member 18 of the rotatable ring 17 of the top half 10.

In an embodiment, the stationary support ring 27 of the bottom half 20 may extend beyond the height 25 of the side 24 of the bottom half 20 therein allowing the second threaded member 28 to extend above the top 21 of the bottom half 20 whereas the first threaded member 18 of the top half 10 may not extend beyond the height 5 of the top half 10. As a result of the stationary support ring 27 extending beyond the height 25 of the bottom half 20 more objects 50 (such as medication) may be stored within the interior 8 of the device 1 without accidently falling out of the interior 8 of the device 1.

In an embodiment, the first threaded member 18 and the second threaded member 28 may corresponding lock into each other such that to remove the top half 10 from the bottom half 20 a user must push downward on the top half 10 of the device 1 while simultaneously twisting the top half 10 with respect to the stationary bottom half 20. As a result of the complex twisting and depressing required, a child is prevented from gaining access to the interior 8 of the device 1 while an adult is easily able to open the device 1.

In an embodiment, the interface between the top half 10 and the bottom half 20 units may create a substantially air-tight seal when used properly. The airtight seal provides a barrier to air ingress and increases freshness while extending product shelf-life. The positive interface my also creates a condition which generates an audible que to the user upon opening that the seal has been broken. Even further, in an embodiment, a tamper evident band may be utilized along the circumference of the container via a break away tab or plastics strip between elements 10 (top) and 20 (base).

Figure 3:
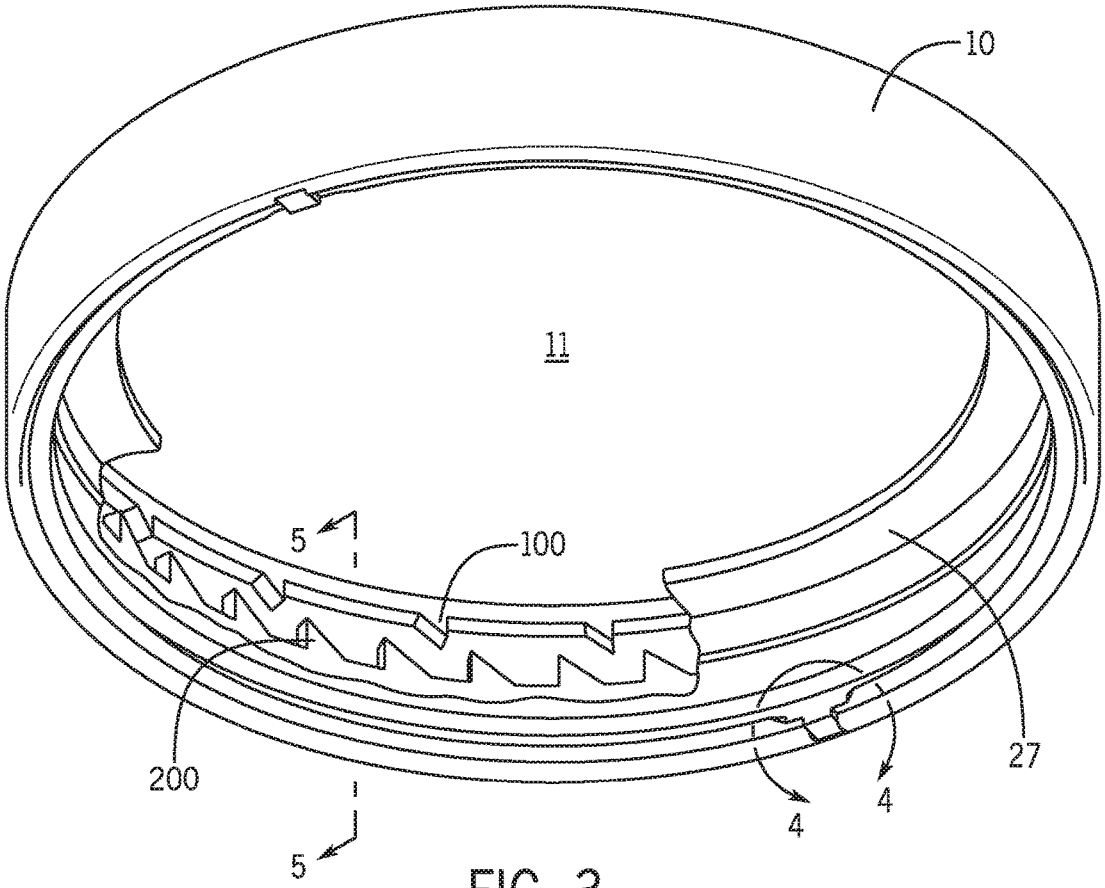
FIG. 3 illustrates a perspective view of the top half with locking teeth exposed under the top surface of the top half.

Referring now to FIGS. 3, 7, in an embodiment, the device 1 may have a plurality of locking teeth 100, 200 located on the top half 10. The locking teeth 100, 200 may be absent on the bottom half 20 of the container 1. All the locking teeth 100, 200 may be located between the rotatable ring 17 of the top half 10 of the device 1 and an interior surface of the stationary portion 11 of the top half 10 of the device 1. In an embodiment, the first set of locking teeth 100 may be physically connected with the stationary portion 11 of the top half 10 of the container 1 and may not move independently with the stationary portion 11 of the top half 10. The second set of locking teeth 200 may be located on an interior facing surface of the rotatable ring 17. More specifically, the first set 100 of the locking teeth 100 may be part of the stationary portion 11 of the top half 10 of the container 1 whereas the second set of locking teeth 200 may be part of the rotatable ring 17 of the top half 10 of the container 1. Both sets of locking teeth 100, 200 may be located between the rotatable ring 17 and the stationary portion 11 of the top half 10 of the device 1.

In an embodiment, the locking teeth 100 of the top half 10 may be fewer in number than the locking teeth 200 of the rotatable ring 17. The locking teeth 100, 200 of both of the top half 10 and the rotatable ring 17 may be generally triangular in shape, having a right angle 250 (FIG. 7). The locking teeth 100 of the top half 10 may be orientated in a manner so as the perpendicular side of the triangular locking teeth 100 of the top half 10 contacts the perpendicular side of the triangle of the locking teeth 200 of the rotatable ring 17 in a flush manner when the locking teeth 100, 200 are engaged with each other as shown in FIG. 7. The triangular shape of the locking teeth 100, 200 prevents the device 1 from opening in both directions as the locking teeth 100 of the stationary portion 11 will typically slide over the locking teeth 200 of the rotatable ring 17 if moved in an opposite direct as shown in FIG. 7. As a result, a user must twist the device 1 in the correct direction.

Figure 2:
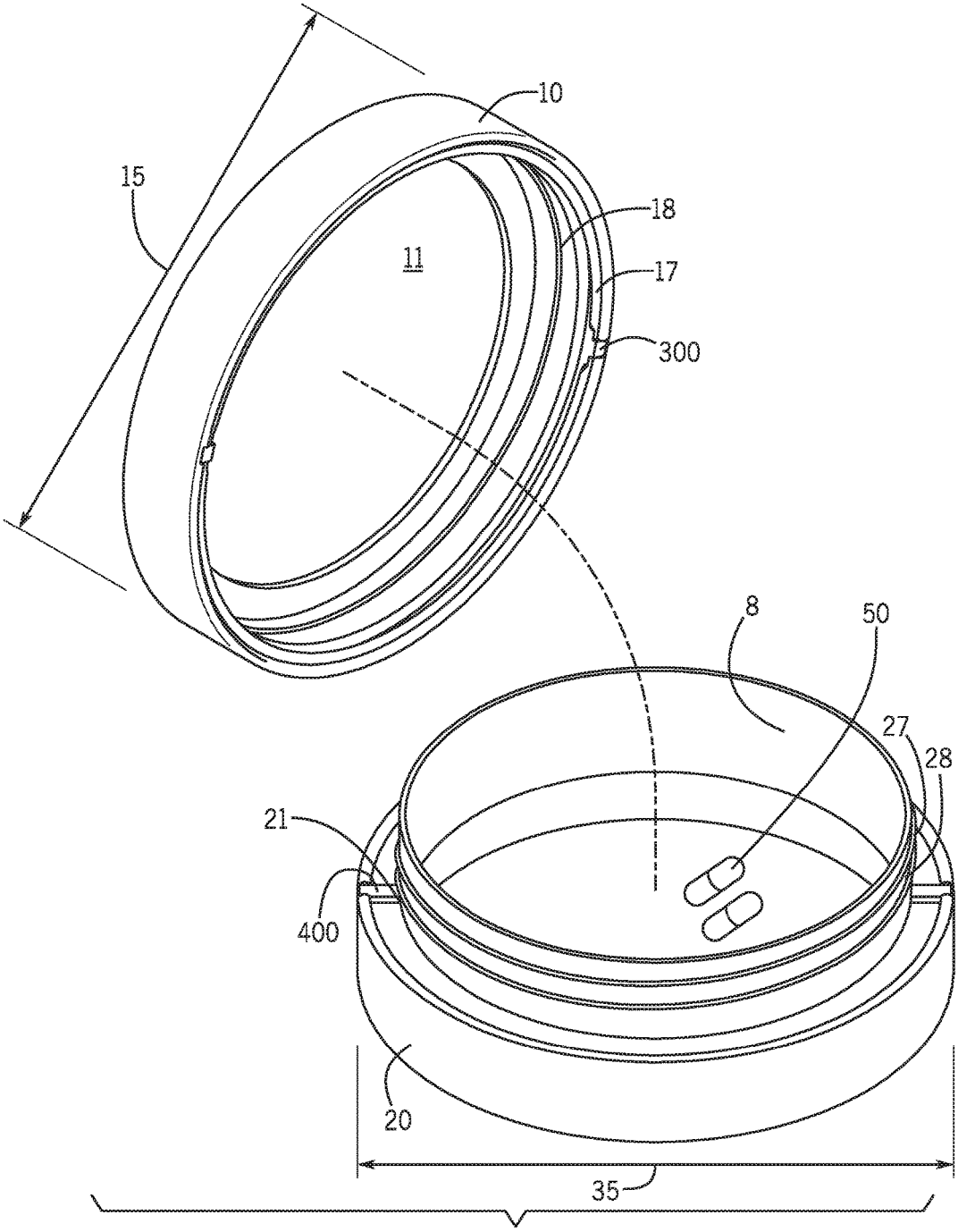
FIG. 2 illustrates a perspective view of the device wherein the top half of the child resistant storage container is separated from the bottom half and wherein the interior of the container is visible.

In one embodiment, the rotatable ring 17 may have a height which covers the locking teeth 100 of the stationary portion 11 as is shown in FIG. 2. FIG. 3 illustrates a cut-away so that the locking teeth 100 of the stationary portion 11 are partially visible. Covering the locking teeth 100 of the stationary portion 11 helps protect the locking teeth 100 from damage and further prevents injury to the user.

The rotatable ring 17 may move up and down, from a first position (FIG. 5) to a second position (FIG. 6). The rotatable ring 17 may rotate completely around the stationary portion 11 of the top half 10 of the device 1 in the first position (FIG. 5) without contacting the locking teeth 100 of the stationary portion 11; however, the rotatable ring 17 does contact the locking teeth 100 of the stationary portion 11 in the second position. In the second position, the rotatable ring 17 may not fully rotate as a result of the locking teeth 200 of the rotatable ring 17 contacting the locking teeth 100 of the stationary portion 11 of the top half 10 (FIG. 6).

Figure 5:
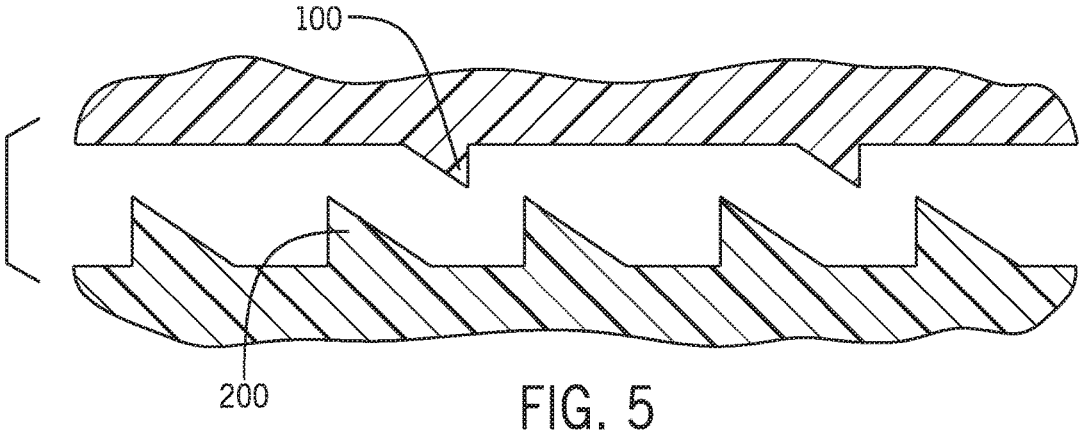
FIG. 5 illustrates a cross section of the container wherein the locking teeth of the top half are separated and the top half exterior may rotate with respect to the ring of the top half and wherein the container may not be opened.

If a user twists the top half 10 of the container 1 with respect to the bottom half 20 of the container 1 without first depressing the top half 10 of the container 1 toward the bottom half 20 of the container 1, the stationary portion 11 of the top half 10 of the device 1 will rotate freely as in FIGS. 3 and 5 and the container 1 may not be opened since the threaded member 18 of the rotatable ring 17 will be locked into the threaded member 28 of the stationary support ring 27 by friction and nothing will act to move the rotatable ring 17. However, if a user first or simultaneously depresses the top half 10 of the container 1, the stationary portion 11 of the top half 10 will move downward toward the rotatable ring 17 of the device 1 (which is already locked into place secured to the threaded member 28 of the bottom half 20) so that the locking teeth 100 of the stationary portion 11 of the top half 10 are along the same plane as the locking teeth 200 of the rotatable ring 17 of the top half 10 (as is shown in FIGS. 6 and 7) and the container 1 may now be opened.

More specifically, the container 1 may now be opened since the locking teeth 100 of the stationary portion 11 will push the locking teeth 200 of the rotatable ring 17 (and therefore rotatable ring 17 itself) and the rotatable ring 17 has the threaded member 18 which will then move with respect to the second threaded member 28 of the bottom half 20.

When the top half 10 is depressed and a user twists the top half 10 of the container 1 with respect to the bottom half 20, the top half 10 unscrews along the threaded members 18, 28 and the top half 10 is separated from the bottom half 20 at the threaded members 18, 28. The top half 10 may then be completely separated from the bottom half 20 and the interior storage area 8 of the container 1 may be accessed. Spring tension in the rotatable ring 17 will return the top half 10 of the container 1 to the orientation of FIGS. 3 and 5 wherein the locking teeth 100, 200 are not along the same plane as each other and the container 1 may not be opened without first twisting. A user may simply twist the top half 10 with respect to the bottom half 20 in the opposing direction in order to resecure the top half 10 to the bottom half 20.

Figure 4:
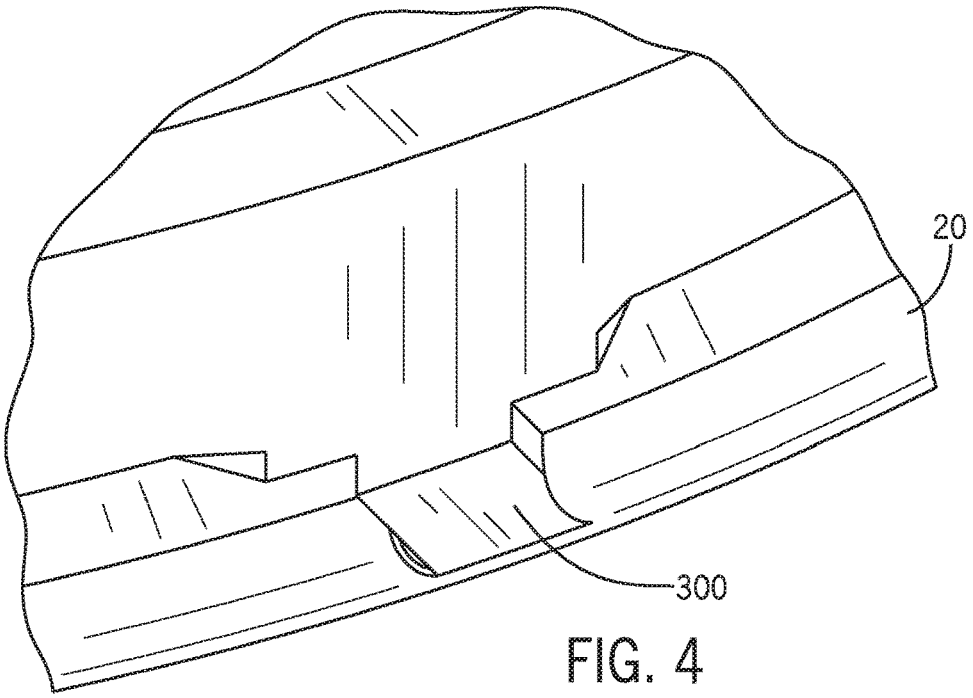
FIG. 4 illustrates a perspective view of the cut away portion of the top half of the container.

In an embodiment, the top half 10 of the container 1 may have a recessed portion 300 as is shown in FIG. 4 and the bottom half 20 may have a recessed portion 400 as shown in FIG. 2. The recessed portion 300, 400 of the top half 10 and the bottom half 20 may be a folded tab edge which helps secure the rotatable ring 17 to the top half 10 and helps secure the stationary support ring 27 to the bottom half 20 and prevent the rings 17, 27 from becoming separated from the top half 10 and bottom half 20 of the container; respectively.

Although embodiments of the invention are shown and described therein, it should be understood that various changes and modifications to the presently preferred embodiments will be apparent to those skilled in the art. Such changes and modifications may be made without departing from the spirit and scope of the invention and without diminishing its attendant advantages.

We claim:

1. A child resistant storage container comprising:

a housing have a top unit having a perimeter and a bottom unit having a perimeter and a hollow interior;

wherein the top unit is removably and selectively attached to the bottom unit;

wherein the top unit has a base portion and a rotatable ring portion wherein the rotatable ring portion is secured to the base portion and wherein the base portion moves between a first position and a second position with respect to the rotatable ring portion;

a plurality of teeth integral with the base portion of the top unit and a plurality of teeth integral with the rotatable ring portion;

wherein the base portion is capable of rotating fully around the rotatable ring portion of the top unit when the base portion is in the first position;

wherein the plurality of teeth of the base portion of the top unit and the plurality of teeth of the rotatable ring portion do not contact each other in the first position but contact each other in the second position when the base portion is rotated with respect to the rotatable ring portion; and wherein the plurality of teeth of the base portion are triangular in shape and wherein the plurality of teeth of the rotatable ring portion are triangular in shape and wherein the plurality of teeth of the base portion have an angled side and a perpendicular side and wherein the plurality of teeth of the rotatable ring portion have an angled side and a perpendicular side and wherein the perpendicular side of the both the base portion and the rotatable ring portion meet in a flush manner when the base portion is pushed downward toward the rotatable ring portion and the base portion is rotated in one direction but wherein the perpendicular side of the base portion and the rotatable ring portion do not meet in a flush manner when the base portion is rotated in the opposite direction.

2. The child resistant storage container of claim 1 further comprising:

a threaded member on the rotatable ring portion of the top unit.

3. The child resistant storage container of claim 2 further comprising:

a threaded member on the bottom unit wherein the threaded member of the bottom unit correspondingly fits with the threaded member of the rotatable ring portion.

4. The child resistant storage container of claim 1 wherein the top unit and the bottom unit are magnetic and attracted to each other.

5. The child resistant storage container of claim 1 further comprising:

indicia located on the top unit.

6. The child resistant storage container of claim 1 wherein the top unit and the bottom unit are cylindrical.

7. The child resistant storage container of claim 1 wherein a user must move the base portion of the top unit into the second position and further rotate the top unit with respect to the bottom unit in order to separate the top unit from the bottom unit.

* * * * *